US005386116A

United States Patent [19]

Kilius et al.

[11] Patent Number: 5,386,116

[45] Date of Patent: Jan. 31, 1995

[54] METHOD FOR REDUCING ISOBARIC INTERFERENCES IN ACCELERATOR MASS SPECTROMETRY

[76] Inventors: Linas R. Kilius, 30 Rosemount Avenue, Thornhill L3T-6S7; Albert E. Litherland, C3 Hawthorn Gardens, Toronto M4W 1P4, both of Canada

[21] Appl. No.: 125,910

[22] Filed: Sep. 24, 1993

[51] Int. Cl.[6] ..... H01J 49/28

[52] U.S. Cl. ..... 250/288; 250/282

[58] Field of Search ..... 250/288, 288 A, 281, 250/282; 436/123

[56] References Cited

U.S. PATENT DOCUMENTS 4,037,100 7/1977 Purser ..... 250/281

5,120,956 6/1992 Purser ..... 250/281

OTHER PUBLICATIONS

Science, vol. 236, pp. 543–550 (May 07, 1987) D. Elmore, et al, "Accelerator Mass Spectrometry".

Annual Rev. of Nucl. Particle Science, v. 30, pp. 437–473, (1980).

Sakabe, S., and Yazukazu, I., "Cross Sections for Resonant Transfer between Atoms and their Positive Ions", Atomic and Nicl Data Tables v. 49, pp. 257–314 (1991).

Rapp D., and Franics, W. E., Jour. Chem. Phys. 37 No. 11, (1962) p. 2631.

*Primary Examiner*—Paul M. Dzierzynski

*Assistant Examiner*—Kiet T. Nguyen

*Attorney, Agent, or Firm*—Nields & Lemack

[57] ABSTRACT

Resonant charge transfer is used to reduce isobaric interferences in accelerator mass spectrometry.

5 Claims, 1 Drawing Sheet

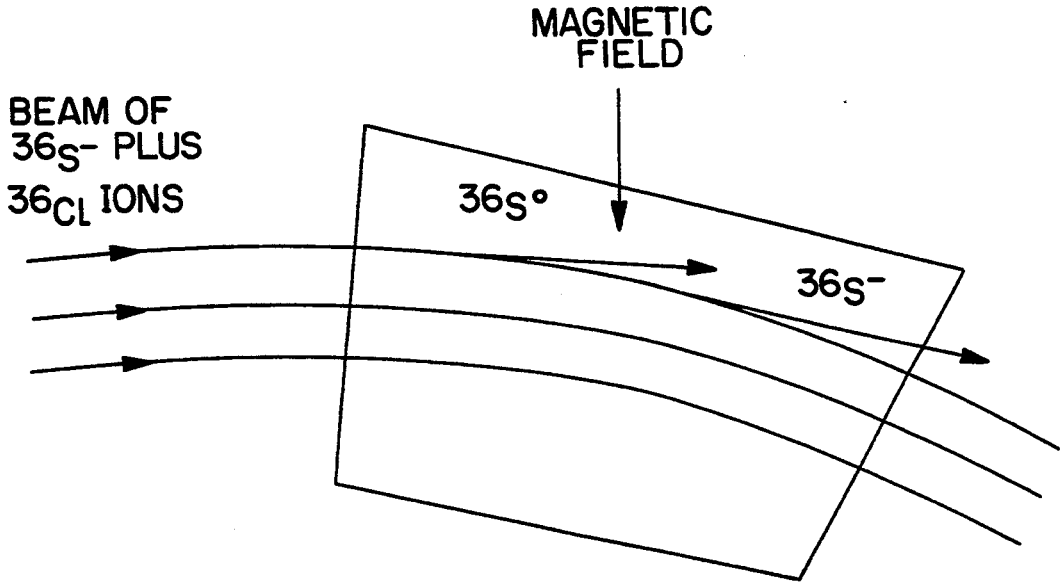
MAGNETIC FIELD
BEAM OF $^{36}S^-$ PLUS $^{36}Cl$ IONS
$^{36}S^\circ$
$^{36}S^-$

METHOD FOR REDUCING ISOBARIC INTERFERENCES IN ACCELERATOR MASS SPECTROMETRY

FIELD OF THE INVENTION

This invention relates to accelerator mass spectrometry.

DESCRIPTION OF PRIOR ART

Accelerator mass spectrometry (AMS)is the term often applied to a collection of techniques, based upon the use of an accelerator, that makes possible the measurement of isotopic ratios below $10^{-12}$. The methods have been described, for example, U.S. Pat. No. 4,037,100 to K. H. Purser.; A. E. Litherland, "Ultrasensitive Mass Spectrometry with Accelerators". *Ann Rev Nucl. and Particle Sci.,* 30, pages 437–473, (1980). A recent review of AMS techniques, as applied to measurements of the concentration of long-lived isotopes, has been provided by Elmore, D and Phillips, F. M., "Ultra-sensitive Mass Spectrometry", Science, 296,543 (1987)

A central problem for AMS ultra-high sensitivity detection of radioactive atoms is that there is usually an isobar that has substantially the same mass as that of the desired radioactive atom. Even though these isobars have a different atomic number, and it might be expected they should be completely eliminated by careful chemistry, the sensitivity of AMS is so great that residual traces of isobars are often still present in the purified sample. Also, because the mass differences between isobars is extremely small, high transmission arrangements of dispersive electric and magnetic deflection fields seldom have the dispersion needed to provide isobar separation Thus, the wanted radioactive ions and the isobaric background ions can pass unattenuated through the whole AMS system and into the final detector. An important purpose of the higher energies used in AMS is that isobars can be separated by the rate-of-energy-loss method, range methods, complete electron stripping or gas filled magnets. While for light ions isobar separation becomes possible using these techniques, for the heavier radioisotopes isobaric backgrounds often establish a significant limitation to ultimate detection limits.

An example of such an isobar problem is the measurement of the long-lived isotope $^{36}Cl$ present in underground aquifers. $^{36}Cl$ is introduced to the biosphere through spallation of $^{40}Ar$ by cosmic rays and can be used to derive the time a sample of water has been away from the surface. There are two stable isobars of the radioactive $^{36}Cl$ atoms: $^{36}Ar$ and $^{36}S$. Because it does not form negative ions $^{36}Ar$ is not a problem. However, $^{36}S$ is strongly electronegative and provides a troublesome background. Even after careful chemical separation the background count rates from the $^{36}S$ isobar may be many thousands per second compared to the wanted count rates of $^{36}Cl$ of a few per second or less. The procedure presently used for eliminating this background is to accelerate the ions to an energy of at least 30 MeV where dE/dx techniques can be used to distinguish individual $^{36}Cl$ and $^{36}S$ events. To realize such energies requires the use of nuclear physics accelerators operating at voltages between 6–10 million volts. Such equipment is physically large, is found only at major nuclear facilities and requires the services of a professional staff for operation and maintenance.

SUMMARY OF THE INVENTION

The present disclosure describes a method and apparatus needed for substantially reducing the intensity of isobaric interferences. Applying the technique will allow substantial reductions in the necessary terminal voltage of AMS spectrometers. The effect will be to allow reductions in the size and cost of AMS installations.

The method is based upon the elimination of the undesirable isobars near the ion source. The mechanism used is based upon a fact that has been known for many years that the cross sections from processes such as $$Cs^{+}+Cs \rightarrow Cs+Cs^{+}$$

are large. For example, at 1 keV the cross section for the above resonant process is about $2.6.10^{--}cm^2$. In contrast, the cross section for $$Cs^{+}+Rb \rightarrow Cs+Rb^{+}$$

is very much smaller: $\sim 4\ 10^{-16}\ cm^2$. A theory for describing these processes has been presented by Sakabe, S., and Yazukazu, I., "Cross Sections for Resonant Transfer between Atoms and their Positive Ions", in *Atomic and Nuclear Data Tables* 49, p 257–314 (1991) and more general descriptions of the theory have been presented by Massey, H. S. W. and Gilbody, H. B. "Electronic and Ionic Impact Phenomena", Oxford University Press. v4, page 2579 (1974). For corrections to equation 445 in the above book by Massey and Gilbody see Rapp, D., and Francis, W. E., Jour. Chem. Phys.37, number 11, (1962) page 2631.

In the case where the atoms are identical or the electron binding energies are substantially the same, the probability of a symmetrical resonant charge transfer is large up to quite large values of the impact parameter. The complete system is described by a pair of eigen functions, one of which is symmetric and the other antisymmetric, which are superposed so that the electron can be found on one atom or the other depending on the relative phases. Before the interaction the electron which may be transferred will be associated with a particular nucleus. As the atoms pass each other coupling between the atoms causes the electron to oscillate between the two atoms. The cross section for this process becomes large when the electron binding energies for both atoms are substantially the same and when the relative velocity is low. The system is the atomic analog of a pair of weakly coupled pendulums whose periods are equal and energy is transferred from one to the other. For the case where the two atoms are distinct and the electron binding energies substantially different, resonance conditions will no longer be present and the electron transfer cross sections will much lower.

This invention comprehends a method for eliminating an unwanted component of a negative ion beam directed through a cell containing atoms or molecules which have an electron affinity within 100 electron volts of the electron affinity of the negative ions to eliminate the unwanted component in the negative ion beam.

BRIEF DESCRIPTION OF THE DRAWINGS

FIG. 1 is a diagram showing the action of the resonance exchange region within a bending magnetic field.

DESCRIPTION OF THE PREFERRED EMBODIMENT

The principle of the present invention is that the differences between such resonant and non-resonant processes can be exploited in a device for either enhancing or attenuating a particular elemental species. For example, using the above reactions a beam of $Cs^+$ would be attenuated in Cs vapor more than a beam of $Rb^+$ because the cross section for $Rb^+ \rightarrow Rb$ is about ten times less than that for $$Cs^+ + Cs \rightarrow Cs + Cs^+.$$

An expression that can be used for calculating the probability of electron transfer is given by equation 445 on page 2594 of "Electronic and Ionic Impact Phenomena" by Massey and Gilbody. Some specific examples for hydrogen, helium and cesium are shown in FIG. 23.80 in the above publication. Although limitations in scope are not intended, using an equation similar to Massey and Gilbody's expression 445 and integrating over all impact parameters the following cross sections can be calculated for 2.0 keV sulpher and chlorine ions passing through a vapor cell containing atomic sulpher:

$$S^{31} + S \rightarrow S + S^- \ldots \sigma_{-1,0} \sim 1.7.10^{-14}\ cm^2 \quad (1)$$

$$Cl^{31} + S \rightarrow Cl + S^- \ldots \sigma_{-1,0} \sim 1.2.10^{-15}\ cm^2 \quad (2)$$

The individual cross sections for these two reactions differ by more than an order of magnitude. Thus, if these reactions were applied to isobaric separation of $^{36}S$ from $^{36}Cl$, where the combined beam is directed through an enclosure filled with a low pressure of atomic sulpher vapor, a very few collisions are needed to reduce the $^{36}S^-/Cl^{36}$ ratio by a factor of about fifty, the expected ratio of the neutralization and formation charge exchange cross sections, $\sigma_{-1,0}/\sigma_{0,-1}$, for sulfur ions in atomic sulpher ($\sigma_{0,-1}$, becomes important because the $^{36}S^-$ particles lost as neutrals can be reintroduced to the beam by conventional charge changing). In contrast to conventional charge changing however, resonant cross sections are sufficiently great that the average impact parameter is large and small angle scattering is greatly reduced.

The above restoration of $^{36}S^-$, due to $\sigma_{0,-1}$, can be largely avoided if the resonance exchange region in the cell which has an entry and an exit openings and is located within a bending magnetic field as shown in FIG. 1. Any particles that are neutralized, leave the beam tangentially and are rapidly lost from the primary beam. Because each resonance interaction will attenuate the unwanted beam by a factor of two only ten such interactions are needed to reduce the $^{36}S-$ by a factor of one thousand. On average the wanted 36Cl ions will only see a single non-resonant interaction.

A second application of resonant exchange is to eliminate metastable states of negative ions which may have very high loss cross sections. An example is the metastable state of $^{14}C^-$. The requirement for metastable $C^-$ removal in precision AMS measurements arises because the primary $C^-$ ions are normally derived from sputter sources. Such devices produce approximately 94% of the $C^-$ ions in the ground state (bound by ~1.27 eV) and the remainder in a metastable state (bound by ~0.05 eV). Because of their weaker binding,the metastable ions are much more susceptible to neutralization by collisional charge changing in the residual gas than are the ground state ions. Thus, the loss of ions from each component of the $^{14}C^-$, $^{13}C^-$, $^{12}C^-$ ensemble is not only dependent upon the vacuum pressure but also upon the ratio of metastables/ground state ions leaving the source and upon the ion velocity, which differs for each isotope.

One method for reducing these differential effects is to remove the metastables selectively by resonance neutralization. Clearly, it would not be appropriate to pass the ions through a cell filled with carbon atoms because this would attenuate both species. Rather it would be necessary to pass the ions through a cell that is filled to a low pressure with atoms having a similar electron affinity (0.05 eV). Exact resonance is not essential and application of the uncertainty principle suggests that an atom with an electron affinity within ~50 meV will still have a substantial resonance cross section for neutralization. One possibility is calcium vapor. Calcium is known to have an electron affinity of ~0.022 eV and is monatomic in the vapor state.

We claim:

1. A method for eliminating an unwanted component of a negative ion beam in an accelerator mass spectrometer comprising the step of directing said negative ion beam through a cell containing atoms or molecules which have an electron affinity within 100 electron volts of the electron affinity of said negative ions to eliminate said unwanted component in said negative ion beam.

2. The method of claim 1 wherein said cell having openings for entry and exit of said negative ions.

3. The method of claim 2 wherein said cell is located within a magnetic field.

4. The method of claim 2 wherein the said negative ion beam is a negative carbon beam and the atoms within said cell are atomic calcium.

5. The method of claim 2 wherein the said negative ion beam is a mixture of negative chlorine and sulphur ions and the atoms within said cell are atomic sulphur.

* * * * *